United States Patent [19]

Baulch et al.

[11] 4,048,681

[45] Sept. 20, 1977

[54] PATIENT LIFT BOARD

[76] Inventors: Evelyn Mae Baulch; John Alan Baulch, both of 3314 Glendora Drive, San Mateo, Calif. 94403

[21] Appl. No.: 723,517

[22] Filed: Sept. 15, 1976

[51] Int. Cl.[2] ..... A61G 7/08; A61G 1/00; A47G 21/00; A47G 9/00

[52] U.S. Cl. ..... 5/81 R; 5/82 R; 5/317 R; 5/338

[58] Field of Search ..... 5/81 R, 81 B, 82, 327 R, 5/327 B, 338, 337

[56] References Cited

U.S. PATENT DOCUMENTS

| | | | |
|---|---|---|---|
| 2,347,389 | 4/1944 | Baker et al. | 5/82 |
| 2,777,138 | 1/1957 | Gallagher | 5/327 R |
| 2,834,032 | 5/1958 | Scott | 5/327 R |
| 2,856,614 | 10/1958 | O'Leary | 5/327 |
| 3,293,669 | 12/1966 | Emery | 5/327 R |
| 3,648,308 | 3/1972 | Greenawalt | 5/338 |
| 3,829,914 | 8/1974 | Treat | 5/81 R |

*Primary Examiner*—Paul R. Gilliam
*Assistant Examiner*—V. N. Sakran
*Attorney, Agent, or Firm*—Flehr, Hohbach, Test, Albritton & Herbert

[57] ABSTRACT

A patient lift board for manipulation by a single attendant of a patient having back complications and being confined to a bed. The lift board is rigid having one smooth side for sliding contact with the bed surface. The opposing side of the rigid board is covered with a padding for contacting a patient from a point on the patient's back at the lower end of the spine to a point at the back of the patient's head. A plurality of hand holds are provided about the periphery of the rigid board for manual engagement by the attendant. A wedge member is configured with horizontally opposed base and apex and having a side for contacting the bed surface and an opposing side for contacting the smooth surface of the rigid board, thereby elevating the patient's head above the bed surface while simultaneously supporting the patient's back.

5 Claims, 3 Drawing Figures

PATIENT LIFT BOARD

BACKGROUND OF THE INVENTION

This invention relates to a board for moving and positioning bed confined patients, and more particularly to such a board which may be utilized by a single attendant.

Hospital beds in the past have been specially configured for folding at one or more positions laterally across the bed so that the trunk of a patient confined thereto may be elevated by elevating the head end of the bed and so that support may be provided under a patient's legs by elevating a portion of the bed lying thereunder. These beds are relatively complicated and expensive, requiring lead screws and operating cranks to be mounted in appropriate positions on the bed. Moreover, movement of patients over the bed surface who are unable to assist themselves requires more than one attendant, particularly if the patients to be moved have back complications and require rigid support throughout the entire back area during movement. Movement of patients with such back problems in the past has required application of a back brace beforehand. When patients with back complications are to be transferred from the bed to a wheel chair, such a back brace is necessary. Previously the back brace was applied by two or more attendants while the patient is in a prone position, which is most inconvenient considering the back brace includes rigid structure, usually metal, which extends around the hips with two upright rigid straps on each side of the spine extending to and engaging the upper portions of the shoulders.

A device is desirable which would allow a single attendant to handle application of a back brace on a patient while the patient is in a sitting or semisitting position on the bed surface, and which would allow a single attendant to move the patient laterally or longitudinally over the bed surface as well as providing for elevation of the upper part of the patient's body while confined to a conventional type bed.

SUMMARY AND OBJECTS OF THE INVENTION

In general, the invention disclosed herein includes a rigid board having a predetermined length for extending from the base of the patient's spine to a point above or beyond the back of the patient's head, and having a width for supporting the patient's back. One side of the rigid board is smooth and relatively friction free having no protrusions therefrom so that it easily slides over the upper surfaces of an underlying bed. The other side of the rigid board has padding attached thereto for cushioning and supporting the patient's entire back area and head when positioned thereagainst. Peripheral means are provided on the rigid board for manual engagement so that a bed confined patient placed atop the padded side of the rigid board may be moved in sliding fashion laterally and longitudinally on the upper bed surface, and may be placed with the head in an elevated position in the bed while simultaneously continuing to support the entire area at the patient's back.

It is an object of the present invention to provide a patient lift board which allows a single attendant to tend a patient confined to a bed with limited self-movement abilities.

Another object of the present invention is to provide a patient lift board for moving patients with back complications laterally and longitudinally over the surface of a bed while simultaneously providing overall back support.

Another object of the present invention is to provide a patient lift board for use in making the application of a back brace more convenient.

Another object of the present invention is to provide a patient lift board for elevating the upper portion of a bed confined patient's body in the bed.

Another object of the present invention is to provide a patient lift board which provides the advantages of an adjustable elevation hospital bed while obtaining the advantages of a water bed for a bed confined patient.

Additional objects and features of the invention will appear from the following description in which the preferred embodiment has been set forth in detail in conjunction with the accompanying drawings.

DESCRIPTION OF THE PREFERRED EMBODIMENT

Figure 1:
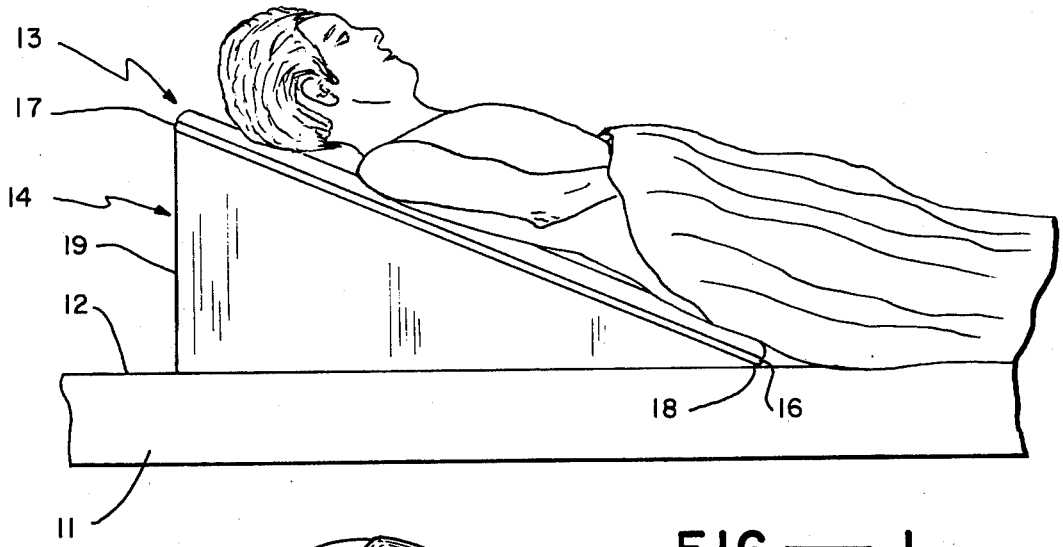
FIG. 1 is a side elevational view of the patient lift board with a patient supported thereon.

FIG. 1 shows a patient confined to a bed shown partially at 11 having an upper surface 12 for supporting the patient. There are disposed on the upper surface 12 the usual bed clothes disposed between the patient and the upper surface. For purposes of clarity, the bed clothes are not specifically shown. The bed 11 is of the conventional type, without the capability of elevation at one end or the other or at any points between the ends. Thus, bed 11 may be the type having a water filled mattress which has been found to alleviate local circulation interference caused by pressure on portions of the patient's body which contact the upper surface 12 of the bed 11. The results of such local circulation interference are seen in what are commonly termed "bed sores", which are causes of great discomfort to patients permanently confined or confined for long periods of time to conventional beds or hospital beds having fiber filled mattresses.

A patient lift board shown generally at 13 is coupled with a wedge member, shown generally at 14, for placement beneath lift board 13. Lift board 13 has a first end 16 for disposal at the lower end of the patient's spine, seen in FIG. 1. Lift board 13 has a predetermined length providing a second end 17 which extends to a position beyond the back of the patient's head, as also shown in FIG. 1. Wedge 14 has a horizontally disposed apex 18 and base 19. With apex 18 in juxtaposition with first end 16 and base 19 in juxtaposition with second end 17, patient lift board 13 is positioned to elevate the head and trunk of the patient above upper surface 12 of bed 11 while simultaneously providing support throughout the back of the patient.

Figure 2:
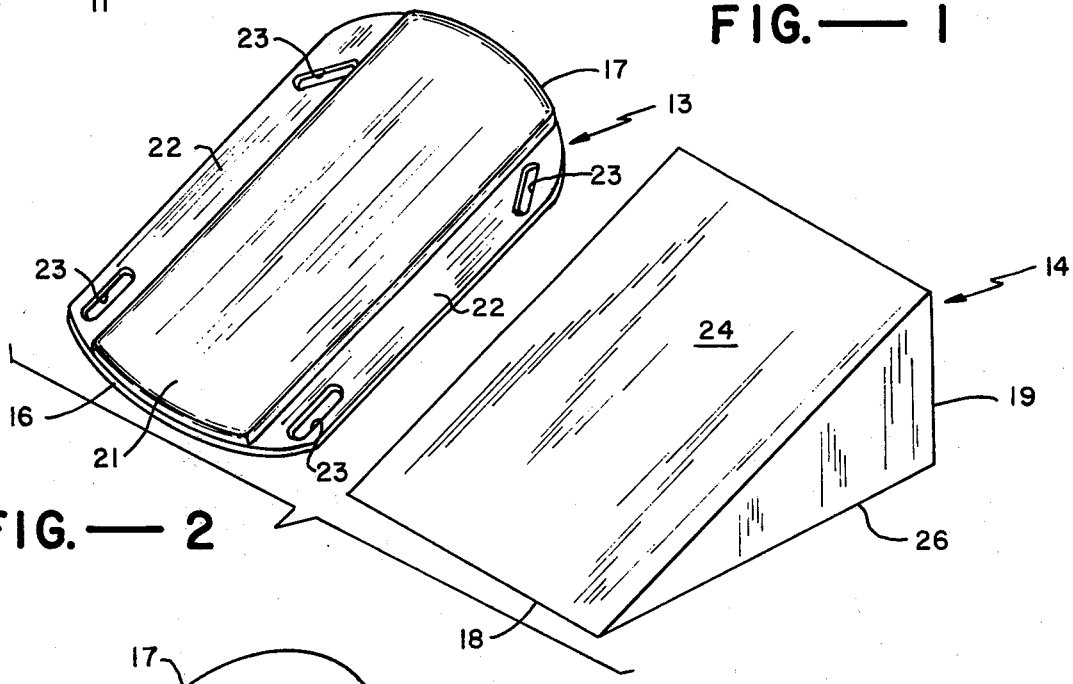
FIG. 2 is an exploded isometric view of a patient lift board and wedge of FIG. 1.

Referring now to FIG. 2, patient lift board 13 is seen to have a padding 21 on the front side thereof having a predetermined width sufficient to extend across the entire back of the patient above the hips at the base of the spine and across the patient's shoulders. Patient lift board 13 has a width which is sufficient to extend laterally in each direction from the side of padding 21, thereby providing unpadded areas 22 on the front side of lift board 13. Unpadded areas 22 have a number of apertures 23 therethrough at first and second ends 16 and 17 which provide hand holds for manual engagement by an attendant manipulating patient lift board 13. Padding 21 may be of any conventional type, such as foam rubber covered and contained by a vinyl sheet for example.

Figure 3:
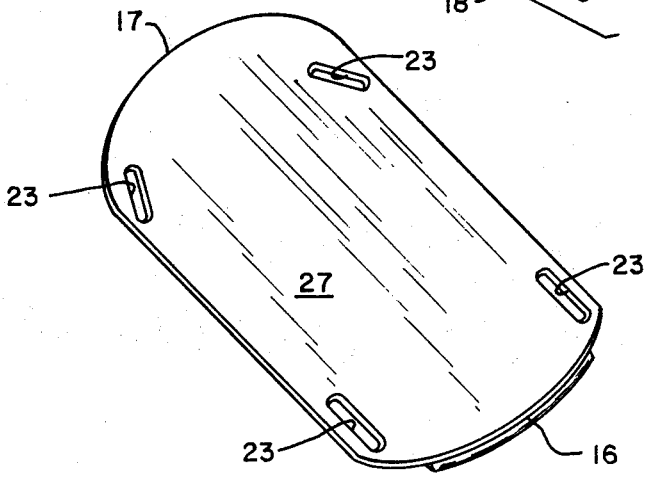
FIG. 3 is an isometric view showing the back side of the patient lift board.

Wedge 14 has one side 24 for contacting and supporting patient lift board 13 and a second side 26 for contacting and being supported by upper surface 12 of bed 11. FIG. 3 shows a back side 27 on patient lift board 13 which is a smooth relatively friction free surface having no protrusions rising thereabove. Smooth back side 27 is contacted by one side 24 on wedge 14 for supporting patient lift board 13 in an elevated manner as seen in FIG. 1. Smooth back side 27 is such as to easily slide over bed coverings lying on upper surface 12 so that a single attendant may easily slip patient lift board 13 beneath a patient lying on upper surface 12. Alternatively one side of the patient may be lifted slightly and patient lift board 13 inserted between the one side and upper surface 12 for sliding beneath the patient so that the patient lies atop patient lift board 13 in contact with and supported by padding 21.

It should be noted that a covering is generally provided for wedge member 14 so that as soiling takes place through usage, the covering may be removed and cleaned. The surfaces 22 on the front side and 27 on the rear side of patient lift board 13 are generally smooth and nonporous in nature, and may therefore be cleansed by wiping with a damp cloth. The surface of padding 21 is generally of a material, such as vinyl sheet mentioned above, so that wiping with a damp cloth will also provide cleansing thereof.

The manner in which the patient is placed atop patient lift board 13 for sliding laterally and longitudinally on upper surface 12 of bed 11 is dependent to some degree upon the condition of the patient. For patients with some mobility one side of the patient may be lifted and the patient lift board slid thereunder with smooth back side 27 sliding on top of upper surface 12 or bed clothes thereon until patient lift board 13 is in proper position beneath the patient. Patients with less mobility may be required to be positioned on one side by means of a conventional pull sheet, the patient lift board 13 placed thereunder and the patient rolled back on top of padding 21 so that padding 21 extends across the patient's back from the base of the spine to a point behind the patient's head. Thus, a single attendant may place the patient on the lift board 13 and move the patient on upper surface 12 of bed 11 unassisted while simultaneously providing uniform support for the patient's back. Moreover, one attendant may manually engage hand holds 23 to lift second end 17 of lift board 13 and thereafter place wedge 14 thereunder with apex 18 in juxtaposition with first end 16 of patient lift board 13. In this fashion the upper portion of the patient's body may be elevated toward a sitting position and more than one wedge member 14 may be used to more closely approach an upright sitting position. With the patient's upper body portion elevated toward the sitting position, the application of the back brace hereinbefore described is facilitated in preparation for moving the patient out of the bed 11 into a wheel chair (not shown) for transportation from the bed.

A patient lift board and wedge member combination has been disclosed which allows a lone attendant to obtain the necessary leverage for inserting the lift board beneath the patient for imparting sliding motion of the lift board and patient over the bed surface and for elevating the patient toward a sitting position, all while simultaneously maintaining support for the entire back area of the patient.

What is claimed is:

1. Apparatus for use in positioning a patient confined to a bed including bed coverings on the upper surface thereof, comprising a rigid board, one end on said rigid board being configured to extend across the width of the patient's back in a position proximate to the bottom of the patient's spine, an opposing end on said rigid board being configured to extend to a position behind the patient's head, a first side on said rigid board having a smooth surface without protrusions therefrom, said first side thereby being adapted for slidable contact with the bed coverings, a second side on said rigid board, padding attached to said second side so that the patient's back is rigidly supported throughout the entire back area during patient movement and the patient's back and head are cushioned from said rigid board, and means for manual engagement on said rigid board at said one end and opposing end, so that the patient may be placed atop said padding and thereafter may be moved by an unassisted attendant in sliding fashion laterally and longitudinally atop the bed coverings as well as in elevation on the bed while simultaneously supporting the patient's back.

2. Apparatus as in claim 1 wherein said means for manual engagement comprises openings in said rigid board adapted to receive the attendant's hands.

3. Apparatus for use by an unassisted attendant in positioning a relatively immobile and heavy patient confined to a bed, comprising a wedge member, a rigid board having a predetermined length and width, first and second ends on said rigid board, a smooth first side on said rigid adapted to contact the bed for sliding motion therewith, a padded second side on said rigid board adapted to contact substantially the entire back area of the patient for cushioned support thereof, a plurality of hand holds at the periphery of said rigid board, whereby a single attendant may slide said smooth first side on the bed to a position under the patient so that said padded second side is in contact with the patient, said first end is located across the lower end of the patient's spine, and said second end is located behind the patient's head, any may thereafter elevate said second end, said wedge member being in contact with said smooth first side and elevating said second end, thereby positioning the patient's head in an elevated position while simultaneously supporting the patient's back.

4. A patient lift and back support board for use with a patient having back complications and being confined to a bed having an upper bedsurface for supporting the patient, comprising a rigid board having one end for disposition at the base of the patient's spine, a smooth first side on said rigid board, said rigid board being without protrusions beyond said smooth first side, a padded second side on said rigid board, adapted to contact and thereby support substantially the entire back area of the patient and the rear of the patient's head, a plurality of hand holds spaced about the periphery of said rigid board, whereby a single attendant may manually engage ones of said plurality of hand holds and place the patient in a position atop said padded second side with said one end at the base of the patient's spine, and thereafter unassisted move the patient laterally and longitudinally in sliding motion over the upper bedsurface and toward an elevated position of the patient's head in the bed.

5. A patient lift and back support as in claim 4 together with a wedge member having a horizontally opposed base and apex, said apex being positioned adjacent said one end of said rigid board, when the patient's head is moved toward an elevated position.

* * * * *